US006378714B1

(12) United States Patent
Jansen et al.

(10) Patent No.: US 6,378,714 B1
(45) Date of Patent: Apr. 30, 2002

(54) TRANSFERSET FOR VIALS AND OTHER MEDICAL CONTAINERS

(75) Inventors: Hubert Jansen, Poisat; Jean-Claude Thibault, Saint Egreve, both of (FR)

(73) Assignee: Becton Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 09/420,979

(22) Filed: Oct. 20, 1999

Related U.S. Application Data

(63) Continuation-in-part of application No. 09/168,502, filed on Oct. 8, 1998

(60) Provisional application No. 60/082,372, filed on Apr. 20, 1998.

(51) Int. Cl.[7] ..... B65D 39/00; B65D 41/10; B65D 47/04

(52) U.S. Cl. ..... 215/249; 141/329; 215/247; 215/251; 215/DIG. 3; 604/411; 604/416

(58) Field of Search ..... 215/249, 251, 215/253, 297, DIG. 3, 247, 248, 250, 252, 295, 296, 308, 307, 324, 325, 326, 327, 341, 352, 355; 222/81, 83, 83.5; 141/2, 25, 26, 27, 28, 329, 330, 18, 21; 604/403, 411, 412, 413, 414, 415, 416, 406; 220/265–268, 278

(56) References Cited

U.S. PATENT DOCUMENTS

| | | | |
|---|---|---|---|
| 37,221 | A | 12/1862 | Dunton |
| 659,519 | A | 5/1900 | De Oliveria |
| 2,342,215 | A | 2/1944 | Perelson |
| 2,388,634 | A | 11/1945 | De Woody |
| 2,524,365 | A | 10/1950 | Smith |

(List continued on next page.)

FOREIGN PATENT DOCUMENTS

| | | |
|---|---|---|
| EP | 0 236 127 A2 | 3/1987 |
| EP | 0 406 374 B1 | 12/1989 |
| EP | 0 065 469 A2 | 5/1992 |

(List continued on next page.)

OTHER PUBLICATIONS

German Patent No. DE 36 18 158 A1, May 30, 1986.
Swiss Patent No. 501 172, Dec. 31, 1970.

(List continued on next page.)

*Primary Examiner*—Lee Young
*Assistant Examiner*—Niki M. Eloshway
(74) *Attorney, Agent, or Firm*—Allen W. Wark, Esq.

(57) ABSTRACT

An improved transferset assembly for transferring fluids between a first container, such as a medicament vial and a second container, such as a syringe, which includes an integral polymeric transfer assembly having a tubular collar portion, a radial portion overlying the rim of the first container, an outer tubular portion and an inner tubular portion which is integrally joined to the outer tubular portion by a radial intermediate web portion, a piercing member telescopically received in the inner tubular portion having a piercing end to pierce the closure sealing the open end of the first container and a removable closure which seals the open ends of the outer and inner tubular portions of the transfer assembly. The tubular collar portion, which may be separate from the inner and outer tubular portions, is formed of composite polymer including a relatively soft polymer and a relatively rigid polymer, such that the free end of the collar portion may be deformed radially inwardly or crimped into the neck of the first container, yet sufficiently rigid to retain its shape following deformation and resistant to creep to maintain a seal between the transfer assembly and the first container. The proximate end of the inner tubular portion includes a sharp edge which seals against the closure of the first container. The preferred embodiment of the closure is frangibly connected to the free end of the outer tubular portion of the transfer assembly and provides a biological seal.

14 Claims, 4 Drawing Sheets

U.S. PATENT DOCUMENTS 2,607,503 A 8/1952 Sonnenberg
2,653,609 A 9/1953 Smith
2,659,370 A 11/1953 Smith
2,667,986 A 2/1954 Perelson
2,953,132 A 3/1960 Richter et al.
3,033,202 A 5/1962 Richter et al.
3,164,303 A 1/1965 Trautmann
3,206,080 A 9/1965 Scislowicz
3,278,063 A * 10/1966 Kranzhoff ..... 215/303
3,356,093 A 12/1967 Monahon
3,357,427 A 12/1967 Wittke et al.
3,610,297 A 10/1971 Raaf et al.
3,674,028 A 7/1972 Ogle
3,779,371 A 12/1973 Rovinksi
3,810,469 A 5/1974 Hurschman
3,826,260 A 7/1974 Killinger
3,838,689 A 10/1974 Cohen
3,872,867 A * 3/1975 Killinger ..... 604/413
3,872,992 A 3/1975 Larson
3,940,003 A 2/1976 Larson
3,977,555 A * 8/1976 Larson ..... 215/247
3,995,630 A 12/1976 Van De Veerdonk
4,020,839 A 5/1977 Klapp
4,048,999 A 9/1977 Kobel
4,067,440 A 1/1978 Lataix
4,153,057 A 5/1979 Kobel
4,187,893 A 2/1980 Bujan
4,210,255 A 7/1980 Pan
4,296,786 A 10/1981 Brignola
4,336,891 A 6/1982 Smith
4,387,879 A 6/1983 Tauschinski
4,412,623 A * 11/1983 Schmidt ..... 215/11.1
4,418,827 A 12/1983 Butterfield
4,425,120 A 1/1984 Sampson et al.
4,460,735 A 7/1984 Froix
4,493,348 A 1/1985 Lemmons
4,505,709 A 3/1985 Froning et al.
4,507,113 A 3/1985 Dunlap
4,564,054 A 1/1986 Gustavsson
4,573,506 A 3/1986 Paoletti
4,573,976 A 3/1986 Sampson et al.
4,576,211 A 3/1986 Valentini et al.
4,588,403 A 5/1986 Weiss et al.
4,607,671 A * 8/1986 Aalto et al. ..... 141/329
4,619,651 A 10/1986 Kopfer et al.
4,624,393 A 11/1986 Lopez
4,639,250 A 1/1987 Rycroft
4,662,878 A 5/1987 Lindmayer
4,672,996 A 6/1987 Floyd et al.
4,673,404 A 6/1987 Gustavsson
4,675,020 A 6/1987 McPhee
4,792,053 A 12/1988 Towne et al.
4,822,351 A 4/1989 Purcell
4,826,491 A 5/1989 Schramm
4,834,149 A 5/1989 Fournier et al.
4,834,152 A 5/1989 Howson et al.
4,850,994 A 7/1989 Zerbet et al.
4,884,703 A 12/1989 O'Meara
4,909,290 A 3/1990 Coccia
4,913,945 A 4/1990 Maruhashi et al.
4,923,447 A 5/1990 Morgan
4,927,423 A 5/1990 Malmborg
4,932,937 A 6/1990 Gustavsson et al.
4,982,740 A 1/1991 Broden
5,006,118 A 4/1991 Yule
5,024,256 A 6/1991 Vadjer
5,035,689 A 7/1991 Schroeder
5,060,812 A 10/1991 Ogle, II
5,088,996 A 2/1992 Kopfer et al.
5,092,840 A 3/1992 Healy
5,116,326 A 5/1992 Schmidt
5,169,385 A 12/1992 Turnball
5,171,214 A 12/1992 Kolber et al.
5,215,538 A 6/1993 Larkin
5,217,433 A 6/1993 Bunin
5,232,029 A 8/1993 Knox et al.
5,232,109 A 8/1993 Tirrell et al.
5,250,037 A 10/1993 Bitdinger
5,275,299 A 1/1994 Konrad et al.
5,279,576 A 1/1994 Loo et al.
5,291,991 A 3/1994 Meyer
5,297,599 A 3/1994 Bucheli
5,342,319 A 8/1994 Watson et al.
5,348,548 A 9/1994 Meyer et al.
5,350,372 A 9/1994 Ikeda et al.
5,352,196 A 10/1994 Haber et al.
5,358,501 A 10/1994 Meyer
5,360,413 A 11/1994 Leason et al.
5,364,386 A 11/1994 Fukuoka et al.
5,385,546 A 1/1995 Kriesel et al.
5,397,303 A 3/1995 Sancoff et al.
5,409,125 A 4/1995 Kimber et al.
5,411,499 A 5/1995 Dudar et al.
5,415,374 A 5/1995 Carroll et al.
5,419,256 A 5/1995 Pollich
5,421,814 A 6/1995 Geary
5,423,791 A 6/1995 Bartlett
5,425,465 A 6/1995 Healy
5,429,256 A 7/1995 Kestenbaum
5,433,330 A 7/1995 Yatsko et al.
5,433,703 A 7/1995 Utterberg et al.
5,435,282 A 7/1995 Haber et al.
5,437,648 A 8/1995 Graves et al.
5,441,487 A 8/1995 Vedder
5,454,409 A 10/1995 McAffer et al.
5,454,805 A 10/1995 Brony
5,466,219 A 11/1995 Lynn et al.
5,470,319 A 11/1995 Mayer
5,470,327 A 11/1995 Helgren et al.
5,474,541 A 12/1995 Ritsky et al.
5,474,544 A 12/1995 Lynn
5,487,737 A 1/1996 Meyer
5,494,170 A 2/1996 Burns
5,501,676 A 3/1996 Niedospial et al.
5,514,116 A 5/1996 Vaillancourt et al.
5,514,117 A 5/1996 Lynn
5,520,641 A * 5/1996 Behnke et al. ..... 604/86
5,520,642 A 5/1996 Bigagli et al.
5,520,661 A 5/1996 La et al.
5,520,665 A 5/1996 Fleetwood
5,520,666 A 5/1996 Choudhury et al.
5,533,983 A 7/1996 Haining
5,533,994 A 7/1996 Meyer
5,549,651 A 8/1996 Lynn
5,566,729 A 10/1996 Grabenkort et al.
5,573,516 A 11/1996 Tyner
5,573,520 A 11/1996 Schwartz et al.
5,573,525 A 11/1996 Watson et al.
5,573,526 A 11/1996 Hess
5,576,392 A 11/1996 Yamamoto et al.
5,598,939 A 2/1997 Watson et al.
5,613,291 A 3/1997 Solomon et al.
5,616,129 A 4/1997 Mayer
5,616,130 A 4/1997 Mayer
5,620,434 A 4/1997 Brony
5,641,010 A * 6/1997 Maier ..... 141/329
5,662,230 A 9/1997 Finneran
5,685,845 A 11/1997 Grimard
5,697,915 A 12/1997 Lynn
5,702,019 A 12/1997 Grimard
5,709,666 A 1/1998 Reynolds

| | | | | |
|---|---|---|---|---|
| 5,718,348 | A | | 2/1998 | Manera |
| 5,776,124 | A | | 7/1998 | Wald |
| 5,776,125 | A | | 7/1998 | Dudar et al. |
| 5,785,701 | A | | 7/1998 | Sams et al. |
| 5,803,284 | A | | 9/1998 | Grimard |
| 5,819,964 | A | | 10/1998 | Grimard |
| 5,833,089 | A | | 11/1998 | Manni et al. |
| 5,855,575 | A | | 1/1999 | Solomon et al. |
| 5,863,655 | A | | 1/1999 | Mock |
| 5,873,872 | A | | 2/1999 | Thibault et al. |
| 5,879,345 | A | | 3/1999 | Aneas |
| 5,891,129 | A | | 4/1999 | Daubert et al. |
| 5,925,029 | A | | 7/1999 | Jansen et al. |
| 5,931,828 | A | | 8/1999 | Durkee |
| 5,954,104 | A | | 9/1999 | Daubert et al. |
| 5,957,898 | A | | 9/1999 | Jepson et al. |
| 6,003,566 | A | * | 12/1999 | Thibault et al. ..... 141/25 |
| 6,050,435 | A | | 4/2000 | Bush et al. |
| 6,056,135 | A | | 5/2000 | Widman |
| 6,070,623 | A | | 6/2000 | Aneas |
| 6,071,270 | A | | 6/2000 | Fowles et al. |
| 6,159,192 | A | | 12/2000 | Fowles et al. |

FOREIGN PATENT DOCUMENTS

| | | | |
|---|---|---|---|
| EP | 0 769 456 A2 | | 10/1996 |
| EP | 0 747 293 A1 | | 12/1996 |
| FR | 3738550 | * | 3/1997 |
| WO | WO 84/04673 | | 12/1984 |
| WO | WO 88/01881 | | 3/1988 |
| WO | WO 92/11056 | | 7/1992 |
| WO | WO 94/03373 | | 2/1994 |
| WO | WO 95/00117 | | 1/1995 |
| WO | WO 95/03841 | | 2/1995 |
| WO | WO 95/14176 | | 5/1995 |
| WO | WO 95/31242 | | 11/1995 |
| WO | WO 95/33505 | | 12/1995 |
| WO | WO 95/35125 | | 12/1995 |
| WO | WO 96/13301 | | 5/1996 |
| WO | WO 97/00702 | | 1/1997 |
| WO | WO 97/10156 | | 3/1997 |
| WO | WO 97/39720 | * | 10/1997 |
| WO | WO 98/13006 | * | 4/1998 |
| WO | WO 98/32411 | | 7/1998 |
| WO | WO 98/37853 | | 9/1998 |
| WO | WO 98/37854 | * | 9/1998 |

OTHER PUBLICATIONS

UK Patent Application No. 2 121 016 A, Jun. 1, 1983.
French Patent No. 950.625, Jul. 28, 1947.
French Patent No. 1.071.487, Feb. 26, 1953.
French Patent No. 1.328.635, Jul. 4, 1962.
French Patent No. 1.487.413, May 20, 1966.
French Patent No. 2.738.550, Sep. 9, 1995 —translation attached.
French Patent No. 2.395.198, Jan. 19, 1979.

* cited by examiner

TRANSFERSET FOR VIALS AND OTHER MEDICAL CONTAINERS

RELATED APPLICATIONS

This application is a continuation in part application of U.S. Ser. No. 09/168,502 filed Oct. 8, 1998 and provisional application Ser. No. 60/082,372 filed Apr. 20, 1998. This application further claims priority to Design Application Ser. No. 29/102,898 filed Apr. 2, 1999.

FIELD OF THE INVENTION

This invention relates to an improved transferset for vials and other medical containers which may be attached to a conventional vial having an elastomeric stopper or other closure for transferring fluid under sterile conditions between a vial or other container and a second container such as a syringe. The collar portion of the transferset is preferably formed of a polymer which may be permanently deformed radially to secure the transferset to the container, yet sufficiently rigid to retain its shape following deformation and resist creep.

BACKGROUND OF THE INVENTION

It is conventional to store medicament such as drugs in a sealed vial or other container for later use. Such medicaments may be in a dry or powdered form to increase the shelf life of the drugs and reduce inventory space. Such dry or powdered drugs are generally stored in a sealed vial and reconstituted in liquid form for administration to a patient by adding a diluent or solvent. Alternatively, the drug may be in liquid or even gaseous form. A conventional vial for storing medicament generally includes an open end, a radial rim portion surrounding the open end and a reduced diameter neck portion adjacent the rim portion. The vial is conventionally sealed with an elastomeric stopper or closure which generally includes a generally tubular portion or annular rib inserted into the neck of the vial and a generally planar rim portion which overlies the vial rim. The stopper is normally secured to the vial with a thin malleable metal cap, such as aluminum. The aluminum cap includes a tubular portion which surrounds the rim portions of the stopper and vial, an inwardly projecting annular rim portion which overlies the rim portion of the stopper and a distal end portion which is crimped or deformed radially into the vial neck beneath the vial rim portion. Because aluminum is malleable, the collar accommodates the buildup of tolerances of the dimensions of the stopper and vial rim. The dimensions and tolerances of standard vials and stoppers are set by the International Standards Organization (ISO).

The radial portion of the aluminum cap which overlies the stopper rim portion may be closed, in which case the aluminum cap is removed by "peeling" the aluminum cap from the vial. A pre-slit tab located in the middle area is provided which overlies the vial rim, permitting the cap to be torn from the top and peeled from the vial prior to use. This embodiment of an aluminum cap has several disadvantages. First, the tearing of the metal cap creates sharp edges which may cut or damage sterile gloves and cut the person administering the drug, thereby exposing both the healthcare worker and the patient to disease and contamination of the drug. Second, the tearing of the aluminum cap generates metal particles which may also contaminate the drug. The dangers associated with the tearing of an aluminum cap has been solved in part by adding a "flip-off" plastic cap. In one such embodiment, the aluminum collar includes a central opening and a shallow plastic cup-shaped cap is received over the aluminum collar having a central projecting riveting portion which is received and secured in the central opening of the aluminum collar. The plastic cap is then removed by forcing the flip-off cap away from the aluminum collar, which tears an annular serrated portion surrounding the central opening and exposes an opening in the collar for receipt of a hypodermic needle or the like. This embodiment reduces but does not eliminate the possibility of tearing the sterile gloves of the healthcare worker. More importantly, however, aluminum dust is still created which may contaminate the medicament. It is also important to note that metallic dust is also created simply by forming and affixing the aluminum collar to the vial because aluminum dust is created in forming the aluminum collar, crimping of the collar and removal of the flip-off plastic cap. Aluminum collars have also been used to secure fluid transfersets on medicament vials. Transfersets may be utilized, for example, to transfer fluid from a syringe to a vial, such as to reconstitute a dry or powdered drug in a vial by adding a diluent or solvent. The reconstituted drug may then be withdrawn from the vial by the syringe. The inner surface of the transferset may be part of the drug fluid path and the aluminum collar or ring may bring aluminum particles in the sterile room where the drug is added to the vial or into the drug fluid path contaminating the drug. There have been attempts to reduce this problem by applying a coating to the aluminum cap or collar. Finally, the prior art also includes snap-on cup-shaped plastic caps or collars having a radially inwardly projecting end portion which is snapped over the rim portion of the vial. Snap-on plastic collars, however, do not assure adequate sealing of the vial or fully accommodate the tolerances of standard vials and stoppers as required.

The prior art also discloses plastic medicament vial transfersets. However, such plastic transfersets are relatively expensive having several interfitting parts and are difficult to use. The need therefore remains for a transferset for vials and other medical containers which may be utilized with conventional containers, such as medicament vials or cartridges, which assures sealing of the container and which achieves a good level of cleanliness, without particles or dust which may contaminate the medicament, the transferset or the clean room and which does not expose the healthcare worker to sharp metal edges. The need also remains for a transferset which may be easily secured to a vial or other medical container and which is relatively inexpensive, simple in construction and easy to use.

SUMMARY OF THE INVENTION

As set forth above, the improved transferset assembly of this invention may be utilized with conventional medicament vials and other medical containers to transfer fluids between the medical container and a second container such as a syringe. The transferset assembly of this invention eliminates the problems associated with malleable metal or aluminum collars, but accommodates the buildup of tolerances of the rim portion of the container and the elastomeric stopper. The transferset assembly of this invention is relatively simple in construction and may be formed of a malleable polymer which has sufficient rigidity to retain its shape following deformation and which is resistant to creep.

The preferred embodiment of the transferset assembly of this invention is adapted for attachment to a conventional medicament vial having an open end, a rim portion surrounding the open end and a reduced diameter neck portion adjacent the rim portion and wherein the open end of the vial is sealed with a conventional elastomeric stopper. The disclosed embodiment of the transferset assembly of this invention is also adapted for transferring fluids between a conventional syringe and a vial and may thus be utilized to reconstitute dry or powdered drugs stored in the vial by adding diluent or solvent to the vial with the syringe. As will be understood, however, the improved fluid transferset of this invention may also be used to transfer fluids between other types of containers, particularly medicament containers, and is therefore not limited in its use or application.

The transferset assembly of this invention includes an integral preferably polymeric transfer assembly including an outer tubular portion preferably having a radial end portion adapted to be connected to the vial or other container and an opposed free end, a cylindrical inner tubular portion spaced radially inwardly from, generally coaxially aligned with and preferably integrally joined to the outer tubular portion having a first end portion which is attached to the container in generally coaxial alignment with the open end of the container and adapted to sealingly engage the container having a free end. The assembly further includes a piercing member which is telescopically received in the inner tubular portion having a piercing end adapted to pierce a closure sealing the open end of the container and an opposed free end. In the most preferred embodiment of the transferset of this invention, the piercing member includes an axial passage including an enlarged intermediate chamber which receives a filter for filtering fluid received therethrough. In another disclosed embodiment, the piercing member includes an external open generally longitudinal channel providing fluid communication through the stopper or closure. As used herein, generally longitudinal means that the passage or channel transmits the fluid longitudinally and thus may include, for example, spiral channels.

Finally, the improved transferset assembly of this invention includes a removable closure sealing the opposed free ends of the inner and outer tubular portions of the transfer assembly sealing the container for later use. The most preferred embodiment of the closure is cup-shaped closure having frangible connectors in the rim portion providing a good seal and permitting easy removal of the closure. The rim of the cup-shaped closure includes an upper and lower portion with the upper and lower portions interconnected by frangible portions spaced circumferentially along the interface separating the two portions and the lower portion retaining the upper portion and the lid to the transferset until severance of the frangible portions. The frangible portions are angularly situated about the axis of the lid so they have some angular and radial strength but are easily compressible. In the disclosed embodiment, the frangible portions are pyramidal shaped and frangible so that the upper portion can be fractured or broken by either tilting or twisting the lid to remove it from the transferset. Further, severance of the frangible portions in response to initial separation of the upper and lower portions serves to provide integral and unmistakable evidence of tampering with the medical container and the medication contained therein. Further, the upper and lower portions include a plurality of paired spacer blocks preferably alternating with frangible portions. These pairs of spacer blocks are of trapezoidal shape and taper axially toward each other. The blocks partially bridge the gap formed between the spaced axial edges of the upper and lower portions and have outer ends that touch or are axially very closely juxtaposed with each other. The closure is fitted over the top of the transferset by simply axially pushing it until the projections deflect slightly and snap onto the transferset. During such installation, the blocks bear axially so that no significant force is transmitted through the frangible portions and consequently prevent braking of the frangible portions during assembly.

In the preferred embodiment of the transferset assembly which is adapted to transfer fluids between a conventional vial having an elastomeric stopper and a second container, the free end of the internal tubular portion includes a sharp edge that deforms the elastomeric stopper during assembly and provides a seal between the opening formed in the elastomeric stopper and the passage through the inner tubular portion. Further, the free end of the inner tubular portion includes an external Luer lock for threaded receipt of a syringe. The piercing member is releasably retained within the passage through the inner tubular portion by interlocking ribs, such that the piercing portion is adjacent or partially penetrates the planar portion of the elastomeric stopper. The free end of the piercing member is preferably generally spherical, such that the syringe engages the free end of the piercing member and drives the piercing portion through the planar portion of the elastomeric stopper. As set forth above, the preferred embodiment of the piercing member includes an axial passage, preferably including a filter. When the piercing end of the piercing member is driven through the planar portion of the elastomeric stopper, communication is provided through the piercing member and the inner tubular portion of the transfer assembly. Alternatively, where the piercing member includes an external generally longitudinal passage, the internal tubular portion of the transfer assembly provides fluid communication for transfer of fluids.

As described above, the transfer assembly of the transferset of this invention is preferably formed of polymer which is sufficiently malleable to permit radial deformation, yet sufficiently rigid to maintain its shape following deformation and resistant to creep. In the preferred embodiment of the transferset assembly of this invention, the integral polymeric transfer assembly includes a tubular collar portion which surrounds the planar portion of the elastomeric stopper and the rim of the vial or other medicament container having a free end which is deformed radially inwardly into the reduced diameter neck portion of the container to secure the transferset to the container. The free end may include an annular resilient ring retained to the internal surface adjacent the free end which prevents rotation of the tubular collar portion on the container.

In the most preferred embodiment of the transferset assembly of this invention, the integral transfer assembly is formed of a compost polymer including a polymer alloy or melt blend which includes a relatively tough soft malleable copolymer and a relatively rigid polymer. The composite polymer is most preferably a polymer alloy of a relatively soft, malleable copolymer and a relatively rigid polymer. The preferred relatively rigid polymer is a polyamide or polycarbonate and the preferred relatively soft copolymer may be selected from polyesters or polyolefins. The resultant polymer alloy or composite preferably has an elongation at yield between 5% and 10% and elongation at brake greater than 100% with a flexural modules of greater than 1900 MPa.

As set forth above, the transferset assembly of this invention may be utilized with a conventional medical vial or other medical container having a conventional elastomeric stopper. In the preferred embodiment of the transferset of this invention, the collar portion is integral with the coaxial tubular transfer assembly thus eliminating the requirement for malleable metal collars or caps, such as aluminum. The transferset assembly of this invention is relatively inexpensive and simple to manufacture, particularly when compared with transfersets having aluminum collars having protective metal coatings. The transferset assembly of this invention assures an excellent seal of the container and can be injection molded in a clean environment or washed, if necessary. Finally, the transferset assembly of this invention accommodates the tolerances of the vial and particularly the buildup of tolerance variations in the combination of a conventional vial and elastomeric stopper. Other advantages and meritorious features of the present invention will be more fully understood from the following description of the preferred embodiments, the appended claims and the drawings, a brief description of which follows.

DETAILED DESCRIPTION OF THE PREFERRED EMBODIMENT

Figure 1:
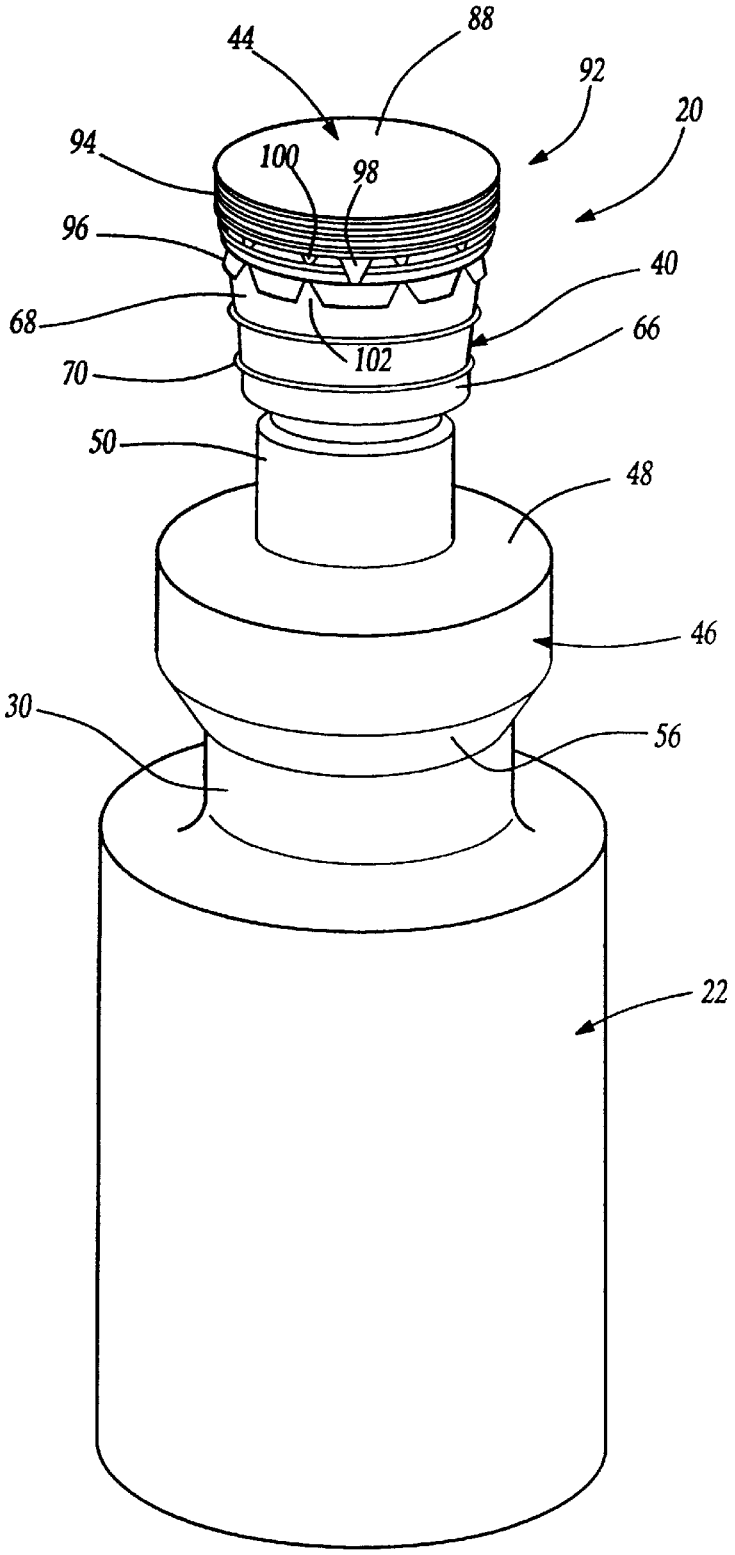
FIG. 1 is a side elevation of a preferred embodiment of the transferset assembly of this invention assembled on a conventional medical vial.
Figure 2:
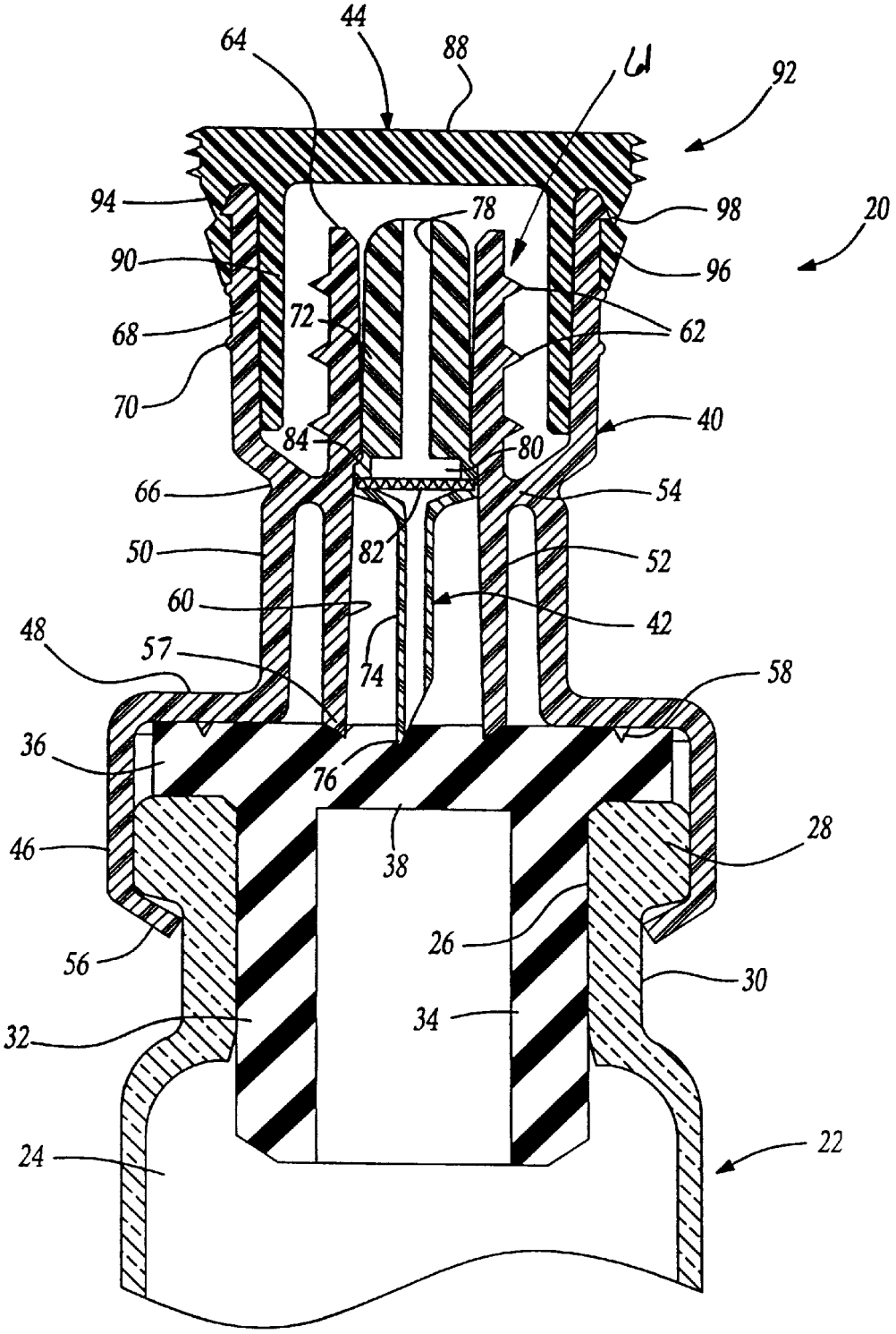
FIG. 2 is a partial side cross-sectional view of the transferset assembly and vial shown in FIG. 1 ready for use.
Figure 3:
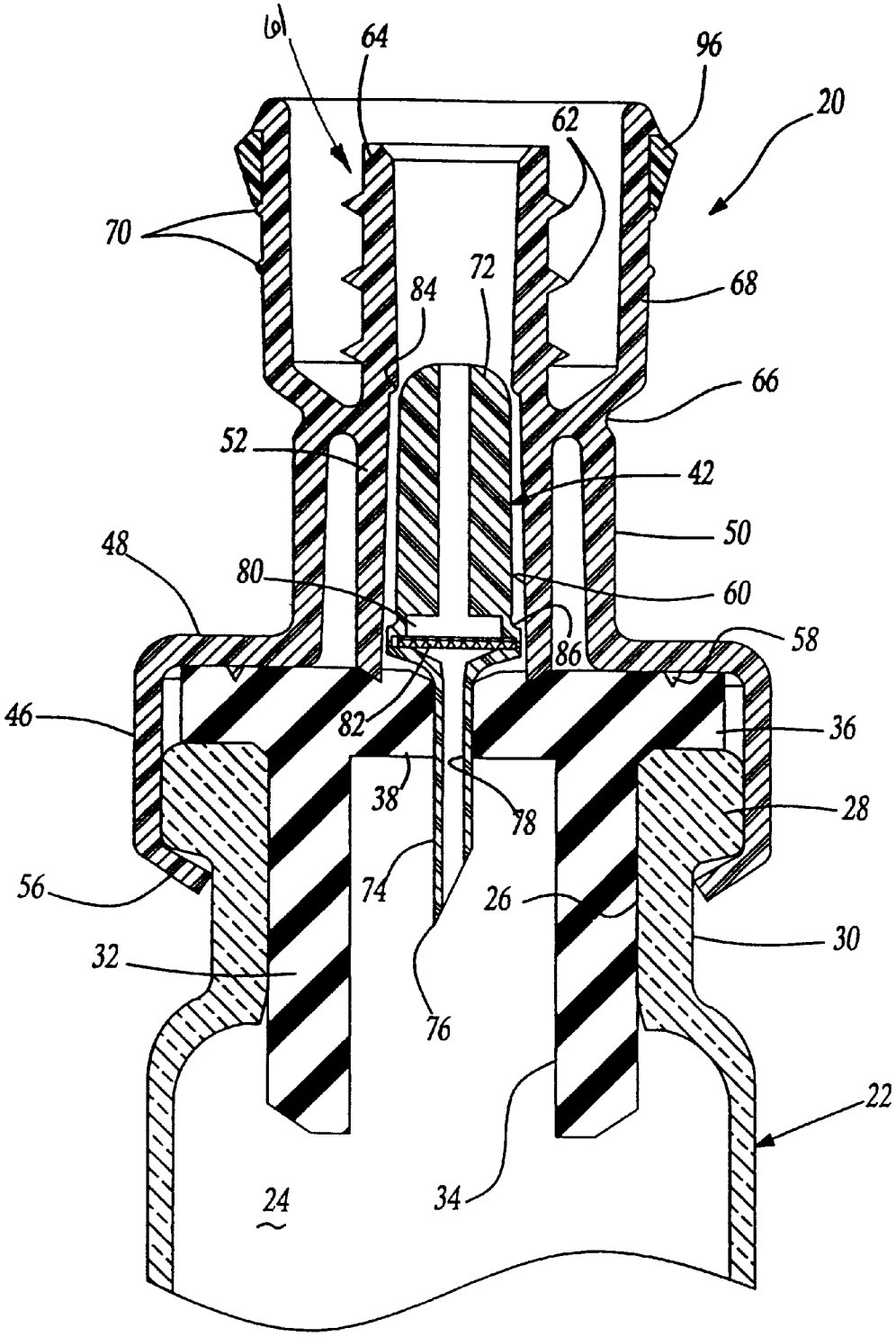
FIG. 3 is a partial side cross-sectional view similar to FIG. 2 following removal of the closure and driving of the piercing member through the planar portion of the elastomeric stopper.

FIGS. 1 to 3 illustrate a preferred embodiment of the transferset assembly 20 of this invention assembled on a conventional vial 22. As set forth above, the transferset assembly of this invention may be utilized to transfer various fluids under sterile conditions between various types of containers. However, the disclosed embodiment of the transferset assembly 20 is particularly, but not exclusively adapted to transfer fluids between medical vials of the general type disclosed and a syringe. The disclosed embodiment of the vial includes an interior 24 which may, for example, contain dry or powdered medicaments, a cylindrical opening 26 and a radial rim portion 28 which surrounds the opening 26. The disclosed embodiment of the vial further includes a reduced diameter neck portion 30 adjacent the rim. Medicament vials of this type are generally formed of glass or a sterilizable plastic. The opening 26 of the vial is typically closed with an elastomeric stopper 32 having a generally tubular body portion 34 and a planar rim portion 36 which overlies the rim 28 of the vial. The stopper 32 is generally formed of a resilient elastomeric material such as synthetic or natural rubber. The central portion 38 of the planar rim portion 36 may be pierced with a hypodermic needle, for example, to either withdraw fluid from the vial or add a solvent or diluent to the vial where the medicament in the vial is a dry or powdered drug. The generally tubular portion 34 of the stopper has an external diameter slightly greater than the internal diameter of the cylindrical opening 26 of the vial to provide a tight or interference fit.

The transferset assembly 20 of this invention includes an integral, preferably polymeric transfer assembly 40, a piercing member 42 which is telescopically supported in the transfer assembly and a cap or closure 44. The integral transfer assembly 40 includes a tubular collar portion or first tubular portion 46, an integral radial portion 48, a second tubular portion or outer tubular portion 50 and a third tubular portion or inner tubular portion 52. In the disclosed embodiment, the outer tubular portion 50 is integrally connected to the inner tubular portion 52 by an intermediate radial web 54. As described more fully hereinbelow, the integral transfer assembly 40, or the tubular collar portion 46 if made as a separate item, is preferably formed of a polymer which is sufficiently malleable to permit radial deformation or crimping, yet sufficiently rigid to maintain its shape following deformation. The collar portion 46 surrounds the planar rim portion 36 of the elastomeric stopper 32 and closely surrounds the rim 28 of the vial and the collar portion includes a free end 56 which is radially deformed or crimped around the rim 28 into the reduced diameter neck portion 30 of the vial to rigidly secure the transferset assembly 20 to the vial. In the preferred embodiment, the radial portion 48 of the transfer assembly includes an annular barb 58 which is compressed into the planar rim portion 36 of the elastomeric stopper during assembly of the transferset assembly on the vial providing an additional seal and a sterility barrier assuring accurate tolerances. The free end 57 of the inner tubular portion 52 preferably is relatively sharp and is driven into the planar portion 36 of the elastomeric stopper, providing the primary seal for the internal passage 60 through the inner tubular portion 52. The inner tubular portion 52 in the disclosed embodiment further includes an external Luer lock connector 61 preferably including threads 62 adjacent its free end 64 for receipt of the tubular portion of a conventional syringe or other medicament delivery system. The outer tubular portion 50 in the disclosed embodiment includes a reduced diameter portion 66 and the free end 68 has a larger diameter than the tubular portion adjacent the radial portion 48 as shown in FIGS. 2 and 3. The free end portion 68 also includes a plurality of spaced annular ribs 70, as shown and further discussed below.

The piercing member 42 is telescopically received in the internal passage 60 of the inner tubular portion 52 of the transfer assembly. The piercing member includes a body portion 72, a reduced diameter piercing portion 74 having a relatively sharp piercing edge 76 in this embodiment, which is adapted to pierce the central portion 38 of the elastomeric stopper. The disclosed embodiment of the piercing member includes an axially longitudinal fluid passage or channel 78 and an intermediate chamber 80 including a filter 82 for filtering fluid transferred through the passage 78. The filter 82 preferably is disc-shaped and may be any conventional filter including porous and semipermeable polymeric filters. The piercing member 42 is releasably retained in the internal passage 60 of the inner tubular member 52 by a rib 84 on the inner tubular portion 52 and an annular concave fillet 86 on the piercing member (see FIG. 3).

The preferred embodiment of the closure or cap 44 provides a sterile seal for the transferset, is easily removed and provides clear evidence of tampering. The preferred embodiment of the cap or closure 44 is best shown in FIGS. 1 and 2. The closure includes an end or lid portion 88, an inner tubular portion 90 which closely receives the free end portion 68 of the outer tubular portion 50 as shown in FIG. 2 and an outer frangible tubular portion 92. The inner tubular portion 90 provides a biological barrier as does the annular barb 58 of the collar portion 46. The outer tubular frangible portion 92 comprises an upper portion 94 and a lower portion 96 interconnected by integral frangible connector portions 98 which are angularly situated about the axis of the closure. The frangible portions 98 are of pyramidal shape and frangible so that the upper portion 94 can be fractured or broken by either tilting or twisting the upper portion 94 to remove the upper portion 94 with the lid portion 88 and the inner tubular portion 90 from the transferset. In addition, severance of the frangible portions in response to initial separation of the upper and lower portions 94 and 96 serves to provide unmistakable evidence of tampering with the medical container and the medication therein.

The upper and lower portions 94 and 96 of the closure further include a plurality of circumferentially paired or opposed spacer blocks 100 and 102, respectively, which in the disclosed embodiment are of trapezoidal shape and tapper axially toward each. The spacer blocks 100 and 102 partially bridge the gap formed between the axially spaced edges of the upper and lower portions and have ends that touch axially or are very closely juxtaposed with each other. The closure is fitted over the top of the free ends of the outer and inner tubular portions 50 and 52 by simply axially pushing the closure until the projections deflect slightly to receive the upper ribs 70 and snap in place. During such installation, the spacer blocks 100 and 102 bear axially together so that no significant force is transmitted through the frangible connectors 98 and thus prevent braking of the frangible connectors 98 during assembly. Following assembly of the closure 44 on the tubular free ends 68 of the outer tubular portion 50 and assembly of the transferset on the vial, the transferset is ready for use. Because the vial and transferset are hermetically sealed, the assembly may be stored as permitted by the medicament contained within the vial.

FIG. 3 illustrates the transferset assembly following removal of the closure and movement of the piercing member 42 to pierce the central portion 38 of the stopper and to provide communication between the interior 24 of the vial and a second container, such as a syringe (not shown). Following removal of the upper portion 94 of the closure by braking the integral frangible connector portions 98, the lower portion 96 remains entrapped between the ribs 70 as shown. In a typical application wherein diluent or solvent is added to dry or powdered medicament in the vial 22 and the reconstituted drug is removed, the tubular barrel portion of the syringe is received over the free end 64 of the inner tubular portion 52 and threaded on the threads 62. During the threading, the barrel portion of the syringe is moved against the body portion 72 of the piercing member 42, driving the sharp end 76 of the reduced diameter piercing portion 74 through the central portion 38 of the elastomeric stopper 32 as shown in FIG. 3. The plunger of the syringe then drives the solvent or diluent through the axial longitudinal passage 78 of the piercing member, through the filter 82 into the interior 24 of the vial. The reconstituted drug may then be withdrawn from the vial by withdrawing the syringe plunger. As will be understood by those skilled in this art, conventional syringes (not shown) include a tubular barrel portion and a plunger which reciprocates under pressure exerted by the healthcare worker and may be withdrawn by pulling on the plunger which withdraws the fluid from the vial.

The preferred polymer selected for the integral transfer assembly 40 can best be described by its physical properties. The polymer must be sufficiently malleable to permit radial deformation or crimping, yet sufficiently rigid to retain its shape following deformation. The polymer must also be sufficiently resistant to creep to maintain the seal between the integral transfer assembly and the container following radial deformation. It has been found that a polymer having an elongation at yield between 5% and 10% and an elongation at break greater than 100%, combined with a flexural modulus of greater than 1,900 MPa has superior performance. Where the integral transfer assembly 40 of this invention is utilized for sealing vials containing a medicament, the polymer should also be sterilizable and, in certain applications such as the vial transferset assembly of this invention, the polymer is preferably relatively clear and maintains its clarity under the stress of deformation or crimping. It has been found that certain polymer alloys or composite polymers including melt blends or alloys and co-polymers having polymers of different malleability and rigidity are preferred in such applications. That is, the plastic integral transfer assembly 40 of this invention is preferably formed of a polymer alloy, composite polymer or co-polymer including a relatively rigid polymer and a tough relatively soft malleable co-polymer. The most preferred polymer is a polymer alloy or melt blend including a polyamide or polycarbonate as the rigid polymer providing the strength and resistance to creep desired for this application. The relatively soft malleable co-polymer may be selected from various polymers including polyesters and polyolefins; however, a polymer alloy including a polycarbonate or polyamide and a polyester has been found particularly suitable for this application.

As will be understood, various polymeric melt blends, alloys, composites and co-polymers are being developed on a rapidly increasing basis and therefore the plastic collar of this invention is not limited to a specific polymer, provided the polymer has the desired physical properties described above. Suitable polymers for the plastic collar of this invention include EASTAR® MB polymers, which are melt blend and alloy polymers and EASTAR® thermoplastic polymers, which are neat polymers sold by Eastman Chemical Company of Kingsport, Tenn. and Eastman Chemical AG of Zug, Switzerland under the trade names "DA003, DN003" and "DN004". These materials are polymer melt blends, alloys and co-polymers of polycarbonate or polyamide and polyester. As used herein, the terms melt blends and alloys refer to polymeric compositions having two or more polymers of different physical properties or characteristics, such as the EASTAR® polymers of Eastman Chemical Company described above which include a polycarbonate or polyamide and a polyester. The polymer selected may also include fillers and other constituents which would be more accurately described as a composite although the base polymers may still be a polymeric melt blend or alloy. As used herein, the term composite is used in its broadest sense to include alloys or melt blends, composites and co-polymers. As will be understood, the manufacturer or supplier of the raw material will normally blend the polymers based upon the specifications of the customer. The polymers may be co-injected to form a polymeric melt blend, alloy or composite or formed by any other suitable processes. It is anticipated, however, that other polymers having the described physical characteristics may also be utilized in the plastic collar or cap of this invention. In certain applications, it may also be desirable to coat at least the interior surface of the collar portion 46 shown in FIGS. 2 and 3 with a thermoplastic elastomer, or the entire collar may have a thin layer of a thermoplastic elastomer. The thermoplastic elastomer coating may be applied as a film or by co-injection with the polymer forming the integral transfer assembly 40. The transfer assembly 40 and the closure 44 may be formed by conventional injection molding processes.

Figure 4:
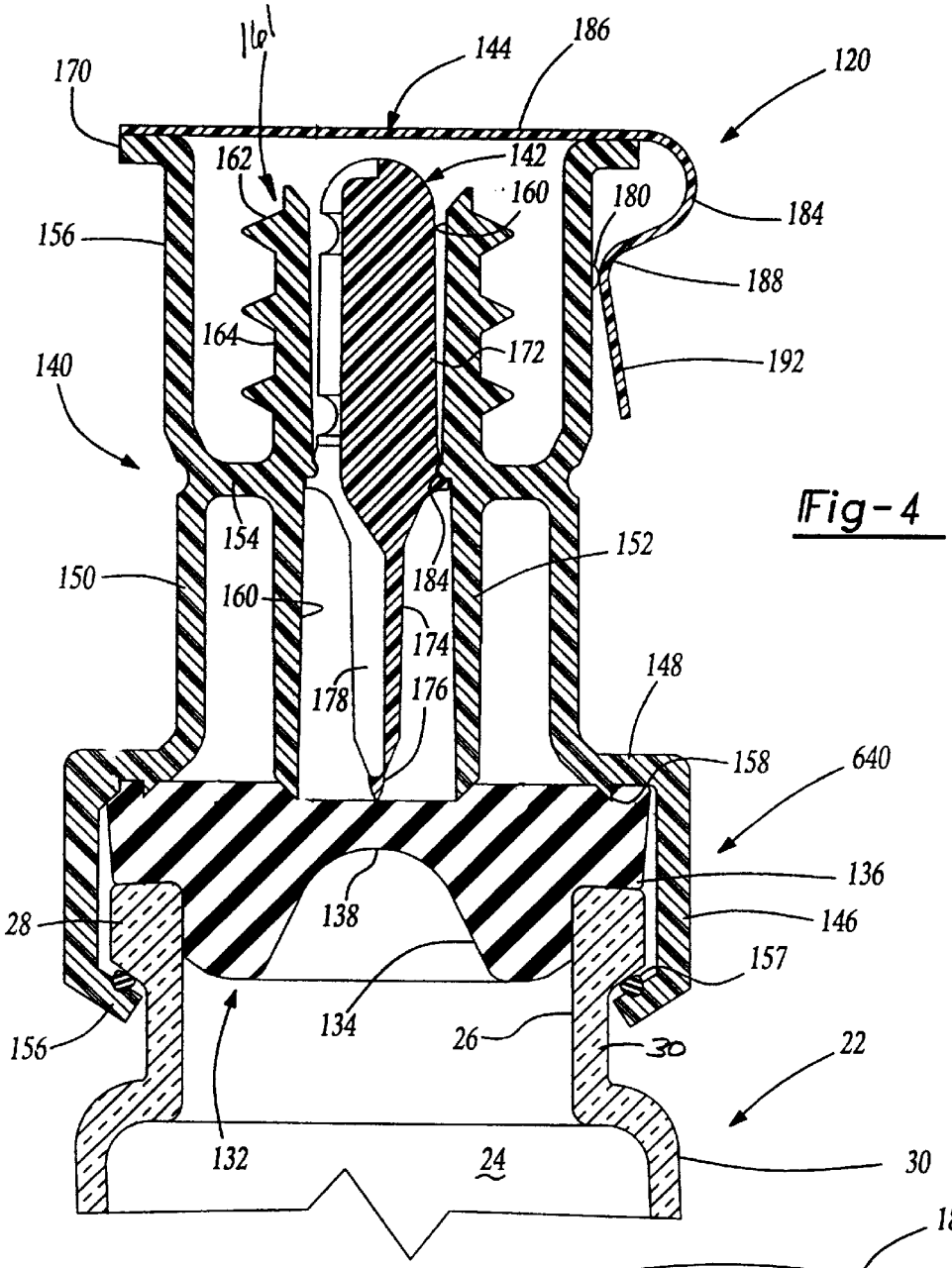
FIG. 4 is a partial side cross-sectioned view of an alternative embodiment of the transferset assembly of this invention assembled on a conventional vial.
Figure 5:
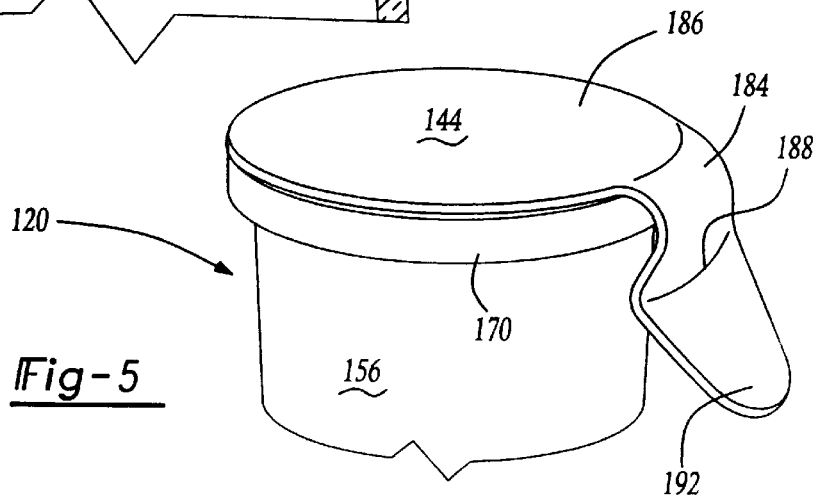
FIG. 5 is a partial top perspective view of the transferset shown in FIG. 4 illustrating an alternative embodiment of the closure.

FIGS. 4 and 5 illustrate an alternative embodiment of the transferset assembly 120 of this invention. Because certain of the components are similar to the components of the transferset assembly 20 shown in FIGS. 1 to 3, the components are numbered in the same sequence to limit duplication of description. The transferset assembly 120 is assembled on a conventional vial 22 as described above. In this embodiment, the elastomeric stopper 132, which is also conventional, includes a generally tubular portion 134, a generally planar rim portion 136 and a reduced diameter central portion 138 which is pierced by the piercing member 142, as described below. The disclosed integral polymeric transfer assembly 140 is very similar to the transfer assembly 40 described above, including the first tubular collar portion 146, the radial portion 148 and the inner and outer tubular portions 152 and 150, respectively. The outer and inner tubular portions are integrally interconnected by a radial web 154. However, in this embodiment, the free end 156 of the outer tubular portion 150 includes a radial flange 170 to receive the closure described below. As described above, the free end 156 of the tubular collar portion 146 is deformed radially inwardly or crimped into the reduced diameter neck portion 30 of the vial. However, in this embodiment, an elastomeric O-ring 157 located in an annular concave groove on the inside surface of the free end 156 of the collar portion which prevents relative rotation of the transferset on the vial. Additional anti-rotation means are provided by the radial barbs 158 which are pressed into the rim portion 136 of the elastomeric stopper when the transferset is assembled on the vial as described above.

The embodiment of the piercing member shown in FIG. 4 includes a body portion 172, a reduced diameter piercing portion 174 and a piercing end 176. The piercing member is releasably retained in the internal passage 160 in the inner tubular portion 152 by an annular rib 184 on the inner surface of the inner tubular portion as described above. In this embodiment of the piercing member, the piercing member includes a V-shaped external channel 178 which extends from adjacent the piercing end 176 through a portion of the body portion 172 rather than a longitudinal channel 78 as described above. When the piercing portion 174 of the piercing member is driven through the center portion 138 of the elastomeric stopper, the V-shaped 178 provides communication through the stopper into the internal passage 160 of the inner tubular portion 152. Thus, when a conventional syringe (not shown) having a female Luer lock connector, for example, is threaded to the threads 162 and the piercing portion is driven through the central portion 138 of the elastomeric stopper, fluid communication is provided between the barrel portion of the syringe and the interior 24 of the vial through the V-shaped channel 178. The external channel 178 provides some advantages over the axial longitudinal passage 78 described above for fluid communication between the interior 24 of the vial and the interior passage 160 when the piercing portion 174 is driven through the central portion 138 of the stopper. A significant advantage is the ability to fully reaspirate any medicament present in the vial. As will be understood, the external channel 178 may be continuous and extend longitudinally as shown or extend spirally or be discontinuous. Otherwise, the piercing member 142 serves the same function as the piercing member 42 described above.

The closure 144 shown in FIGS. 4 and 5 is a peel-off seal which seals the internal components of the transferset, may be easily removed and provides an indication of tampering. The disclosed embodiment of the closure includes a sealing lid portion 186 which is circular to accommodate the shape of the annular flange portion 170 of the outer tubular portion and may be formed of paper, plastic, aluminum or foil which is adhesively bonded to the radial flange portion 170. This embodiment includes an integral tab 184 having a central portion 188 which is welded or adhesively bonded to the free end of the outer tubular portion by glue 180. Securing the central portion 188 to the transferset prevents inadvertent removal of the seal and provides evidence of tampering. The free end 192 of the tab may be easily gripped for peeling off the seal 144 from the transferset. The peel-off seal 144 thus provides sterile sealing of the transferset, can easily be removed and provides evidence of tampering.

As described above in regard to transferset 20, the transferset 120 shown in FIGS. 4 and 5 is assembled on the vial 22 and elastomeric stopper 132 by compressing the radial portion 148 of the transfer assembly against the resilient stopper and then crimping or radially deforming the free end 156 of the collar portion 146 toward the reduced diameter neck portion 30 of the vial. The piercing member 142 is preassembled into the passage 160 of the inner tubular portion from the end 156 to releasably retain the piercing member in the inner tubular portion. Compression of the radial portion 148 against the resilient elastomeric stopper, deforms the stopper in a similar manner described in connection with the example of FIGS. 1 through 3. This assembly can be done under sterile conditions, for example, at the pharmaceutical company where the medicament is added to the interior 24 of the vial, thus assuring the integrity of the medicine. The peel-off seal 144 in FIGS. 4 and 5 and the closure 44 in FIGS. 1 to 3 provides evidence of tampering and assures sterile condition of the transferset prior to use. The peel-off seal 144 is then removed by the healthcare worker and the transferset 120 is utilized to transfer fluid between the vial and a second container, such as a conventional syringe as described above.

As will be understood by those skilled in the art, various modifications may be made to the embodiments of the transferset assembly of this invention within the purview of the appended claims. For example, various closures may be utilized in addition to the closures disclosed herein. Further, the inner and outer tubular portions of the transfer assembly may be separate from the collar portion 46 and 146 wherein, for example, the collar includes a radial portion which overlies the radial portion of the outer tubular portion 50, 150. Further, depending upon the ultimate use of the transferset, the Luer lock 61, 161 may be replaced with a connector suitable for the second container.

What is claimed is:

1. A polymeric fluid transfer member for transferring fluids from a first container having a radial rim portion surrounding an open end and a second container, comprising:

an integral outer tubular member including a tubular collar portion having an open free end adapted to receive said rim portion of said first container and a proximal end, a generally radial portion integral with said proximate end of said tubular collar portion, and a tubular enclosure portion having a diameter less than said tubular collar portion having a proximate end integrally joined, to said generally radial portion and an open distal end; and an inner tubular member having a diameter less than said tubular enclosure portion located within and generally coaxially aligned with said tubular enclosure portion in spaced relation having an open proximal end and an open distal end;

wherein said generally radial portion includes an annular barb extending generally perpendicular to said generally radial portion adapted to sealingly engage a polymeric stopper received in said open end of said first container.

2. The polymeric fluid transfer member defined in claim 1, wherein said proximal end of said inner tubular member has a relatively sharp end adapted to sealingly engage a polymeric stopper received within said open end of said first container.

3. The polymeric fluid transfer member defined in claim 1, wherein said inner tubular portion includes threads on an external surface thereof adjacent said distal end.

4. The polymeric fluid transfer member defined in claim 1, in combination with a piercing member telescopically received in said inner tubular portion having a piercing end adjacent said proximal end of said inner tubular portion and a distal end adjacent said open distal end of said inner tubular portion, said piercing member releasably retained in said inner tubular portion and movable with respect thereto to pierce a polymeric stopper received in said open end of said first container.

5. The polymeric fluid transfer member and piercing member as defined in claim 4, wherein said piercing member includes a body portion and said inner tubular portion including an inner surface having an interlocking rib and groove releasably retaining said piercing member in said inner tubular portion.

6. The polymeric fluid transfer member as defined in claim 1 further including a polymeric closure comprising an end portion overlying said open distal end of said tubular enclosure portion and a tubular closure portion integral with said end portion surrounding said open distal end of said tubular enclosure portion, said tubular closure portion comprising first and second tubular portions integrally connected by longitudinal integral frangible portions permitting removal of said closure by breaking said longitudinally extending integral frangible portions.

7. The polymeric fluid transfer member and closure as defined in claim 6, wherein said closure further includes a second tubular closure portion integral with said end portion having a diameter generally equal to an internal diameter of said tubular enclosure portion extending into said open distal end of said tubular enclosure portion.

8. The polymeric fluid transfer member as defined in claim 1, wherein said outer and inner tubular members are integrally formed of a clear polymer which is sufficiently malleable to permit radial deformation of said open free end of said tubular collar portion, yet sufficiently rigid to retain its shape following deformation and sufficiently resistant to creep to maintain a seal between said open free end of said tubular collar portion and said first container following radial deformation and maintain its clarity.

9. A polymeric fluid transfer member for transferring fluids from a first container having a radial rim portion surrounding an open end and a second container, comprising:

an integral outer tubular member including a tubular collar portion having an open free end adapted to receive said rim portion of said first container and a proximal end, a generally radial portion integral with said proximate end of said tubular collar portion, and a tubular enclosure portion having a diameter less than said tubular collar portion having a proximate end integrally joined to said generally radial portion and an open distal end; and an inner tubular member having a diameter less than said tubular enclosure portion located within and generally coaxially aligned with said tubular enclosure portion in spaced relation having an open proximal end and an open distal end;

wherein said proximal end of said inner tubular member has a relatively sharp end adapted to sealingly engage a polymeric stopper received within said open end of said first container.

10. The polymeric fluid transfer member defined in claim 9, wherein said generally radial portion includes an annular barb extending generally perpendicular to said generally radial portion adapted to sealingly engage a polymeric stopper received in said open end of said first container.

11. A polymeric fluid transfer member for transferring fluids from a first container having a radial rim portion surrounding an open end and a second container, comprising:

an integral outer tubular member including a tubular collar portion having an open free end adapted to receive said rim portion of said first container and a proximal end, a generally radial portion integral with said proximate end of said tubular collar portion, and a tubular enclosure portion having a diameter less than said tubular collar portion having a proximate end integrally joined to said generally radial portion and an open distal end; and an inner tubular member having a diameter less than said tubular enclosure portion located within and generally coaxially aligned with said tubular enclosure portion in spaced relation having an open proximal end and an open distal end;

wherein said inner tubular member includes threads on an external surface thereof adjacent said distal end for threaded receipt of said second container.

12. A polymeric fluid transfer member for transferring fluids from a first container having a radial rim portion surrounding an open end and a second container, comprising:

an integral outer tubular member including a tubular collar portion having an open free end adapted to receive said rim portion of said first container and a proximal end, a generally radial portion integral with said proximate end of said tubular collar portion, and a tubular enclosure portion having a diameter less than said tubular collar portion having a proximate end integrally joined to said generally radial portion and an open distal end;

an inner tubular member having a diameter less than said tubular enclosure portion located within and generally coaxially aligned with said tubular enclosure portion in spaced relation having an open proximal end and an open distal end; and a piercing member telescopically received in said inner tubular member having a piercing end adjacent said proximate end of said inner tubular member, a body portion and a distal end adjacent said open distal end of said inner tubular portion, wherein said body portion of said piercing member and an inner surface of said inner tubular member include an interlocking rib and groove releasably retaining said piercing member in said inner tubular member.

13. A polymeric fluid transfer member for transferring fluids from a first container having a radial rim portion surrounding an open end and a second container, comprising:

an integral outer tubular member including a tubular collar portion having an open free end adapted to receive said rim portion of said first container and a proximal end, a generally radial portion integral with said proximate end of said tubular collar portion, and a tubular enclosure portion having a diameter less than said tubular collar portion having a proximate end integrally joined to said generally radial portion and an open distal end;

an inner tubular member having a diameter less than said tubular enclosure portion located within and generally coaxially aligned with said tubular enclosure portion in spaced relation having an open proximal end and an open distal end; and a polymeric closure comprising an open end overlying said open distal end of said tubular enclosure portion and a tubular closure portion integral with said end portion surrounding said open distal end of said tubular enclosure portion, said tubular closure portion comprising first and second tubular portions integrally connected by longitudinal integral frangible portions permitting removal of said closure by breaking said longitudinally extending integral frangible portions.

14. The polymeric tubular transfer member as defined in claim 13, wherein said closure further includes a second tubular enclosure portion integral with said end portion having a diameter generally equal to an internal diameter of said tubular enclosure portion extending into said open distal end of said tubular enclosure portion.

* * * * *